US005150168A

United States Patent [19]

Kamath et al.

[11] Patent Number: 5,150,168

[45] Date of Patent: Sep. 22, 1992

[54] DUPLEX PRINTER AND METHOD OF PRINTING

[75] Inventors: Venkatesh H. Kamath, Fairport; Michael A. Malachowski; David R. Kamprath, both of Webster, all of N.Y.

[73] Assignee: Xerox Corporation, Stamford, Conn.

[21] Appl. No.: 739,005

[22] Filed: Aug. 1, 1991

[51] Int. Cl.[5] ..... G03G 21/00

[52] U.S. Cl. ..... 355/319; 271/218; 355/322

[58] Field of Search ..... 355/230, 308, 309, 318, 355/319, 321, 322, 23, 24, 25, 26; 271/186, 187, 65, 301, 218

[56] References Cited

U.S. PATENT DOCUMENTS

| | | | |
|---|---|---|---|
| Re. 32,872 | 2/1989 | Buck | 271/218 X |
| 4,116,558 | 9/1978 | Adamek et al. | 355/319 X |
| 4,189,270 | 2/1980 | Ehrlich | 271/218 X |
| 4,305,655 | 12/1981 | Gamblin et al. | 355/24 |
| 4,538,906 | 9/1985 | Brown | 355/319 |
| 4,585,336 | 4/1986 | Tanaka | 355/23 X |
| 4,740,193 | 4/1988 | Frost et al. | 271/218 X |
| 4,772,917 | 9/1988 | Tani | 355/319 |

OTHER PUBLICATIONS

Brooke et al., "Duplex Photocopier", Jan.-Feb. 1979, Xerox Dis. Journal, vol. 4, No. 1, p. 111.

Jenkins, "Sheet Flip Enhancer", Dec. 1980, IBM Tech. Dis. Bulletin, vol. 23, No. 74, pp. 2635-2636.

*Primary Examiner*—A. T. Grimley
*Assistant Examiner*—Shuk Y. Lee
*Attorney, Agent, or Firm*—William A. Henry, II

[57] ABSTRACT

A copying and or printing apparatus including a duplex feeder for feeding sheets having had page image information copied/printed on one side thereof, back to a copying/printing station for transferring page image information to the other side thereof. The duplex feeder includes a buffer tray that can be positioned above and slightly upstream of a feeder tray. The buffer tray stores copy sheets exceeding the maximum capacity of the feeder tray such that the copier/printer can process a greater number of duplex copies in a single run.

26 Claims, 6 Drawing Sheets

DUPLEX PRINTER AND METHOD OF PRINTING

BACKGROUND OF THE INVENTION

1. Field of the Invention

The present invention relates to a copier/printer capable of reproducing duplex images of a document image, and, more particularly, to a duplex feeder of such a copier/printer which stacks sheets which have images on one side thereof and which feeds them back for imaging on the other side thereof.

2. Background of the Invention

When two pages of an original document are copied onto opposite sides of the same copy sheet, it is known as duplex copying. This procedure also has well known applications in printers where it is known as duplex printing. Since the apparatuses can be identical for duplexing in a copier and duplexing in a printer, this discussion will focus on duplex copying. Duplex copying requires the use of a dedicated duplex tray for storing a stack of copy sheets having a simplex image formed on one side thereof from a stack of either simplexed or duplexed original documents. The stack of copy sheets is stored in the duplex tray until the stack of original documents has been copied on a first pass and readied for copying onto the other side of the copy sheets on a second pass. The stack of copy sheets in the dedicated duplex tray is sequentially refed by feeder means to the copying station so that the images of the original documents can be copied onto the opposite side of the copy sheets to form duplex copies. The feeder means of the duplex feeder can be positioned on either the top or the bottom of the stack of copy sheets in the duplex tray. However, it is more desirable to use a bottom feeder means so that the first copy sheet deposited in the duplex tray will be the first sheet fed out of the tray. The term "duplex feeder" is meant to include both the duplex storage tray and the feeder means. Printers require a dedicated duplex tray if a burst mode of operation is used instead of an interleaving mode for productivity reasons.

Typical duplex feeder arrangements, such as the one disclosed in U.S. Pat. No. 4,116,558 to Adamek, include a single duplex tray with the feed means positioned so as to feed copy sheets from the bottom of the stack. The duplex tray arrangement disclosed in U.S. Pat. No. 4,538,906 to Brown also includes a single duplex tray however it shares operation with the feeder of an input copy sheet tray. U.S. Pat. No. 4,772,916 to Tani discloses an intermediate sheet feeder for temporarily stacking copy sheets. The sheet feeder includes first and second intermediate trays (only one of which is used for duplex copying), and first and second feeder devices associated with each tray.

However, arrangements such as these are subject to inherent stack weight limits associated with bottom feeders. Since the stack weight limit of bottom feeders corresponds to a maximum number of copy sheets that can be passed through the simplex run at any one time, the user is required to execute more copy runs if the number of documents to be copied exceeds the copy sheet storage capacity of the duplex feeder. If the storage capacity of the bottom feeder is exceeded, it often leads to mis-feeds and multi-feeds as the bottom feeder cannot properly support the weight of the copy sheets. To alleviate the stack weight problem it has been proposed to use a duplex feeder having two duplex trays and two respective duplex feeders. However, the additional hardware utilized in this approach is both costly and space consuming.

It is apparent from the foregoing that there is a need for a higher capacity duplex feeder. It is therefore a feature and advantage of the present invention to provide a duplex feeder which overcomes the maximum duplex copy sheet handling problem caused by the inherent stack weight limits of bottom feeders.

It is a further feature and advantage of the present invention to provide a duplex feeder which overcomes the above-mentioned problem at a lower cost than would be required to use two duplex feeders and trays.

It is a still further feature and advantage of this invention to provide a buffer tray in addition to the feeder tray for handling copy sheets which exceed a predetermined maximum due to the stack weight limit of the bottom feeder.

It is another feature and advantage of this invention to provide a cost effective and simple way of transferring a stack of simplex copy sheets from the buffer tray to the feeder tray.

It is yet another feature and advantage of the present invention to provide a buffer tray system that is applicable for any bottom feeders where high capacity is desired, e.g., recirculating document handlers and where the sequence of feeding is N-1.

SUMMARY OF THE INVENTION

In accordance with the present invention, a method and apparatus are disclosed for printing page image information onto both sides of a copy sheet in a two pass procedure wherein simplex copy sheets are stored in a duplex buffer tray after the first pass and wherein the duplex copy is made on the second pass. An improvement in the duplex feeder and in the method of feeding copy sheets for duplexing is included which comprises a buffer tray for storing copy sheets having page image information on one side thereof, a feeder tray, a back guide for moving copy sheets from the buffer tray to the feeder tray, a feeder for feeding copy sheets from the feeder tray for printing page image information on the other side of the copy sheets, and a machine controller for sensing that the buffer tray is full, that the feeder tray is empty, and for triggering movement of the back guide.

BRIEF DESCRIPTION OF THE DRAWINGS

For a better understanding of the present invention, reference may be had to the accompanying drawings wherein the same reference numerals have been applied to like parts and wherein.

DETAILED DESCRIPTION OF A PREFERRED EMBODIMENT

Figure 1:
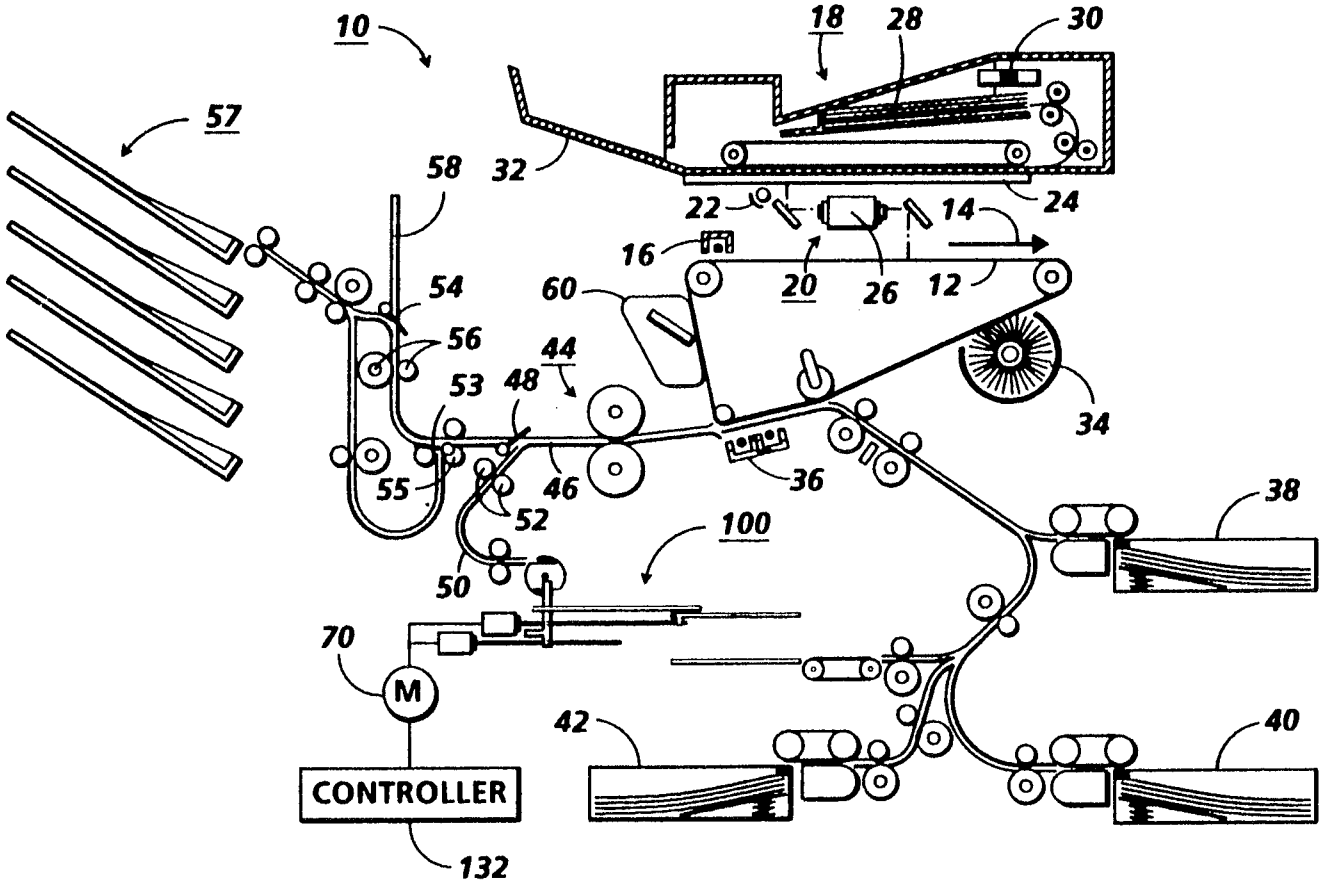
FIG. 1 is a schematic elevational view of copier/-printer that employs a preferred embodiment of the duplex feeder of the present invention.

With reference to FIG. 1, there is shown an electrophotographic printing or reproduction machine 10 employing a belt 12 having a photoconductive surface. Belt 12 moves in the direction of arrow 14 to advance successive portions of the photoconductive surface through various processing stations, starting with a charging station which includes a corona generating device 16. The corona generating device 16 charges the photoconductive surface to a relatively high substantially uniform potential.

The charged portion of the photoconductive surface is then advanced through an imaging station. At the imaging station, an automatic document feeder (ADF) 18 positions an original document face down over an exposure system 20. Exposure system 20 includes a lamp 22 for illuminating the document positioned on transparent platen 24. The light rays reflected from the document are transmitted through lens 26. Lens 26 focus the light image of the original document onto the charged portion of the photoconductive surface of belt 12 to selectively dissipate the charge. This records an electrostatic latent image on the photoconductive surface corresponding to the information areas contained within the original document.

ADF 18 sequentially feeds documents from holding tray 28, in seriatim, to platen 24 via top feeder 30. Since top feeders are not subject to the stack weight limits associated with bottom feeders, top feeders can feed a larger stack of documents in a single run, instead of having to feed several smaller stacks in several runs. The document handling unit 18 drives the documents off the platen 24 after imaging to a position where they are supported on tray 32. Thereafter, belt 12 advances the electrostatic latent page image of each document recorded on the photoconductive surface of belt 12 to a development station. While ADF 18 is shown for illustrating purposes, it should be understood that a recirculating document handler could be used with the present invention with excellent results and a plurality of output trays 57 would not be required.

At the development station a magnetic brush developer roller 34 advances a developer material into contact with the electrostatic latent page image. The latent page image attracts toner particles from the carrier granules of the developer material to form a toner powder page image on the photoconductive surface of belt 12.

After the electrostatic latent page image recorded on the photoconductive surface of belt 12 is developed, belt 12 advances the toner powder page image to the transfer station. At the transfer station a copy sheet is moved into contact with the toner powder page image. The transfer station includes a corona generating device 36 which sprays ions onto the backside of the copy sheet. This attracts the toner powder page image from the photoconductive surface of belt 12 to the copy sheet.

The copy sheets are fed from a selected one of copy sheet input trays 38, 40, or 42 to the transfer station. After transfer, sheets are advanced to a fusing station. The fusing station includes a fuser assembly for permanently affixing the transferred powder page image to the copy sheet. Preferably, fuser assembly 44 includes a heated fuser roller and backup roller with the copy sheets passing between fuser roller and backup roller.

After fusing, conveyor 46 transports the sheets to gate 48 which functions as a duplex selector. Depending on the position of gate 48, the copy sheets will either be driven into duplex feeder transport 50 by nip rolls 52 or deflected into the simplex inverter output gate 54 by nip rolls 56. A copy sheet will be driven into gate 54 if it is a simplex copy to be outputted or if it is a duplex copy to be outputted. If the copy sheet is a simplex copy, then decision gate 54 will deflect the copy sheet into an inverter transport 58 so that the trailing edge of the copy sheet, upon passing nip 53, drops into engagement with nip 55 so that the copy sheets will be outputted image side down at sorter output 57. If the copy sheet is a duplex copy, then decision gate 54 will deflect the copy sheet directly to output 57 as the low number page is already faced down. If a copy sheet is driven into the duplex feeder transport 50 at decision gate 48 by nip rolls 52, then it is received by duplex feeder 100. Duplex feeder 100 provides intermediate or buffer storage for those copy sheets coming from the transfer station having toner powder page images fused on one side thereof. In order to complete duplex copying, the simplexed copy sheets in duplex feeder 100 are fed in seriatim back to the transfer station for transfer of another toner powder page image to the opposite side of the copy sheet and then transported through gates 48 and 54 to the output 57.

Invariably after the copy sheet is separated from the photoconductive surface of belt 12, some residual particles remain adhered to belt 12. These residual particles are removed from the photoconductive surface thereof at a cleaning station 60.

It is believed that the above description is sufficient for one to understand the general operation of the printing/copying machine into which the present invention is incorporated. Now with particular reference to FIGS. 2–3, a preferred embodiment of the present invention is disclosed for providing a duplex buffer tray 102 within the printer/copier to accommodate simplex copy sheets exceeding the predetermined capacity of the duplex feeder tray 104.

Figure 2:
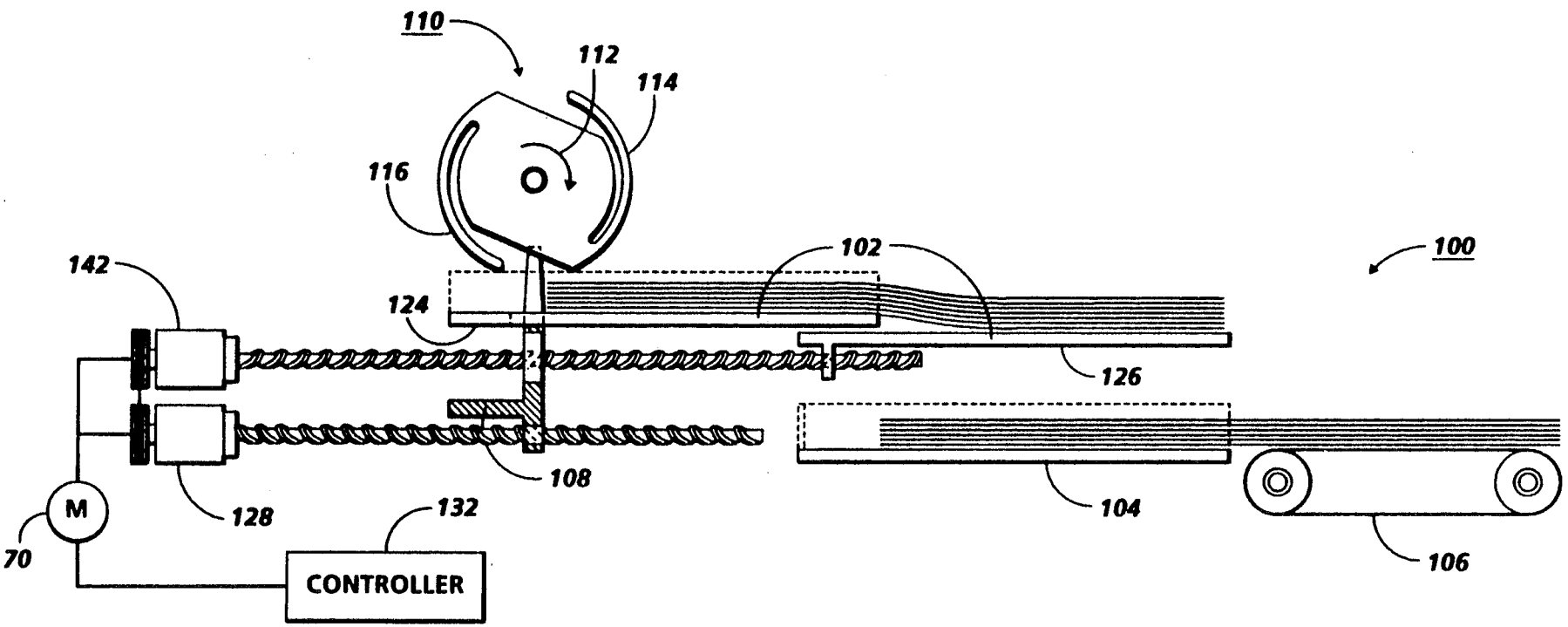
FIG. 2 is an elevational view of the duplex feeder as employed in FIG. 1.
Figure 3:
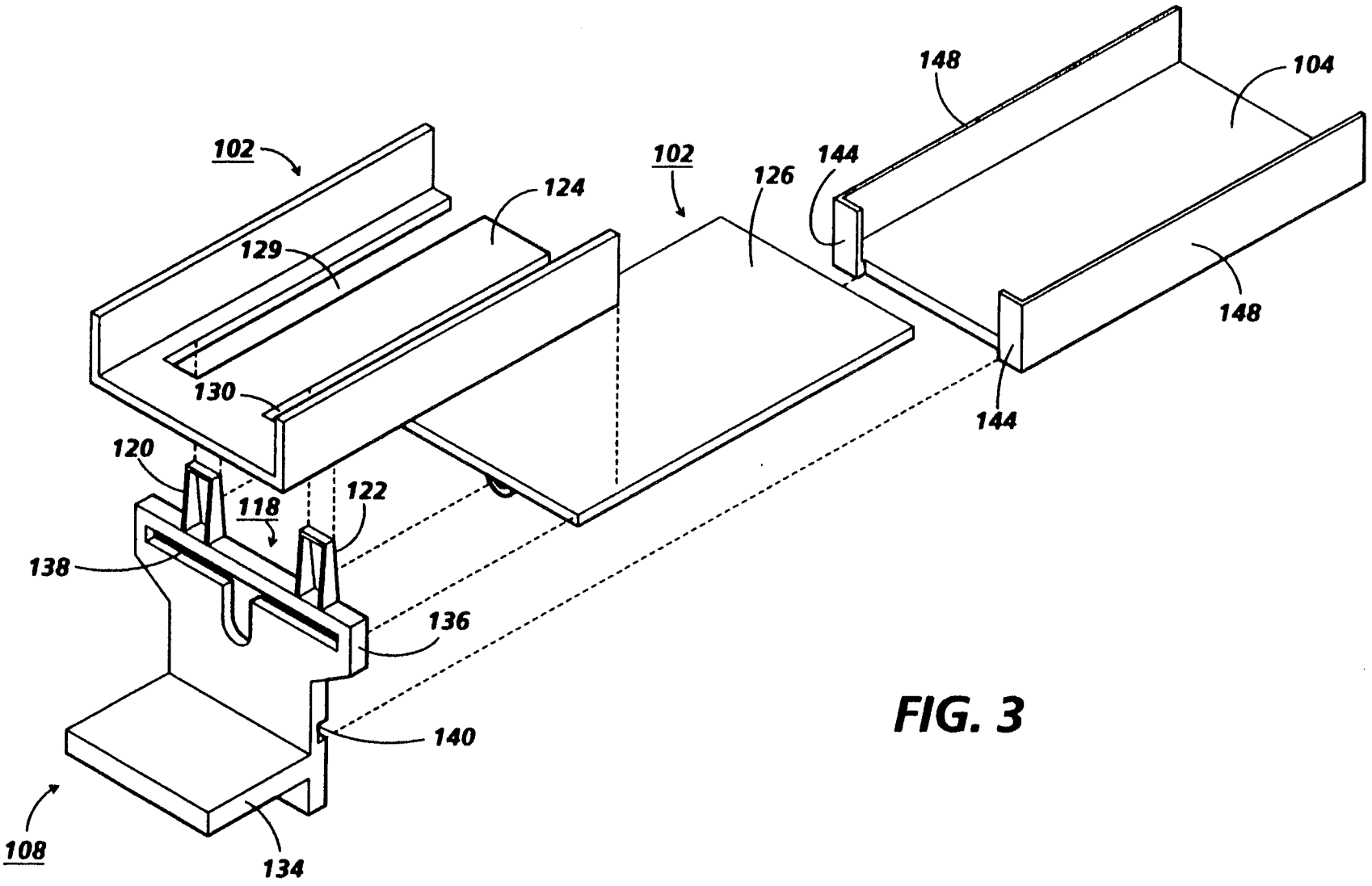
FIG. 3 is an exploded perspective view of the duplex feeder as employed in FIG. 1.

As seen in FIGS. 2–3 the duplex feeder 100 includes buffer tray 102, feeder tray 104, bottom feeder 106, movable back guide 108, and copy sheet inverter 110. Copy sheets arrive at duplex feeder 100 image side down via duplex feeder transport 50. The copy sheets enter the copy sheet inverter 110 which rotates the copy sheets 180 degrees in the direction of arrow 112 such that the copy sheets arrive image side up in buffer tray 102. Copy sheet inverter 110 is cylindrically shaped and includes slots 114 and 116, each of which is for engaging a copy sheet for rotation.

When a copy sheet enters slot 114 or 116 image side down, the copy sheet inverter 110 begins to rotate. As inverter 110 passes through an opening 118 in back guide 108, the copy sheet contacts solid protrusions 120 and 122 of back guide 108 so that the copy sheet disengages from the inverter 110 and falls into buffer tray 102. The copy sheets accumulate in buffer tray 102 such that the simplex images on the copy sheets are face up and such that the copy sheets are vertically aligned in a stack against the back guide 108.

Buffer tray 102 has a fixed portion 124 and a movable portion 126 arranged parallel to each other so that copy sheets can be stacked and extend onto both portions of the buffer tray. Buffer tray 102 is positioned slightly above and upstream of feeder tray 104 in order to permit copy sheets stacked on buffer tray 102 to be moved to feeder tray 104 with the aid of gravity and the movable back guide 108. The fixed portion 124 of the buffer tray has two grooves 128 and 130 extending substantially the entire surface thereof so that solid protrusions 120 and 122 of back guide 108 can pass therethrough.

The movable portion 126 of the buffer tray can be moved underneath the fixed portion 124 of the buffer tray to expose the feeder tray 104 and to permit copy sheets stacked on buffer tray 102 to be moved to feeder tray 104. The movable portion 126 of the buffer tray is a solid platform positioned on a conventional slide rail (not shown) so that it can be reciprocated from an extended position where it is extended over feeder tray 104 to a retracted position where it is retracted under the fixed portion 124 of the buffer tray. The movable portion 126 of the buffer tray is attached to first screw 128 which is driven by motor 70. Motor 70 is controlled by machine controller 132. Machine controller 132 keeps track of the number of simplex copies passing into buffer tray 102. When the predetermined maximum has been reached machine controller 132 triggers motor 70 to either rotate first screw 128 clockwise or counterclockwise thereby either extending or retracting the movable portion 126 of the buffer tray. It should be noted that several buffer trays could be arranged in this manner above the feeder tray to further increase the capacity of the duplex feeder.

Back guide 108 has a horizontal portion 134 and a vertical portion 136. The vertical portion 136 has an opening 138 for receiving the movable portion 126 of the buffer tray therethrough and protrusions 120 and 122 for extending into and moving through grooves 129 and 130 in the fixed portion 124 of the buffer tray and for disengaging the copy sheets from the copy sheet inverter 110. The horizontal portion 134 of the back guide is positioned on a slide rail (not shown) so that the back guide can be reciprocated within grooves 129 and 130 in the fixed portion 124 of the buffer tray from an extended position where back guide 108 abuts the feeder tray 104 to a retracted position where back guide 108 abuts the fixed portion 124 of the buffer tray. The guide also has a groove 140 therein for receiving a portion of the feeder tray 104 when back guide 108 is in the extended position. The horizontal portion 134 of the back guide is attached to second screw 142 which is driven by motor 70. Motor 70 is controlled by machine controller 132. Machine controller 132 keeps track of the number of simplex copies passing into buffer tray 102. When the predetermined maximum has been reached machine controller 132 triggers motor 70 to either rotate second screw 142 clockwise or counterclockwise thereby either extending or retracting back guide 108. A corner section of endwall 144 of feeder tray 104 has been cut away so that back guide 108 can extend over feeder tray 104.

Feeder tray 104 is a solid platform positioned so that the copy sheets stacked thereon can be fed via conventional bottom feeder 106 with drive rolls 146 to the transferring station for duplexing. Feeder tray 104 has side members 148 and end members 144 that form corners so that the copy sheets remain aligned in the feeder tray. Bottom feeder 106 may be a vacuum corrugation feeder (VCF) of the type employed in U.S. Pat. No. 4,411,417. It should be noted that the size shape and positioning of the slide rails, grooves, openings, and protrusions can be varied to achieve the same results.

Figure 4:
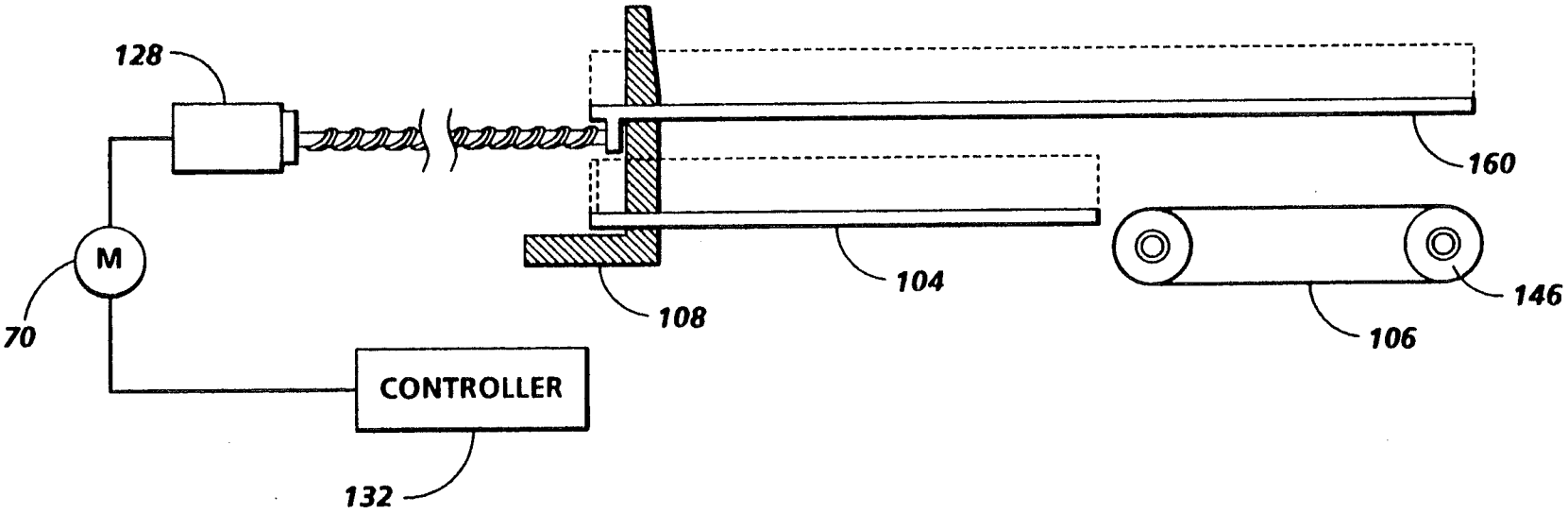
FIG. 4 is an elevational view of another embodiment of the duplex feeder wherein the buffer tray is directly above the feeder tray.
Figure 5A:
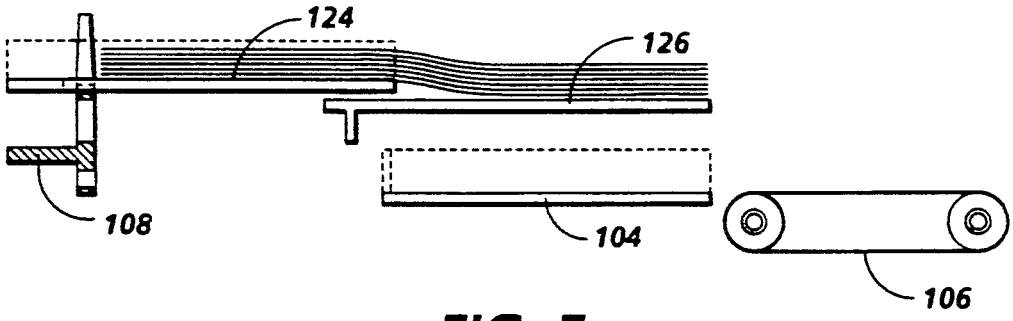
FIG. 5*a* is a schematic representation of the present invention in which copy sheets having images on one side thereof are stacked image side up to fill the buffer tray.
Figure 5B:
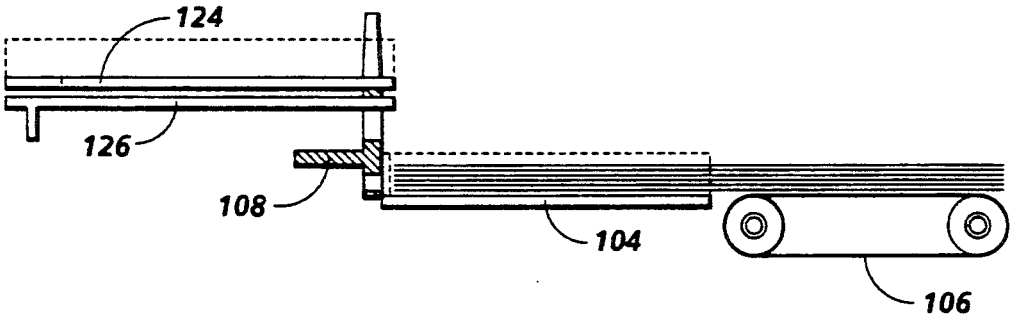
FIG. 5*b* is a schematic representation of the present invention in which copy sheets having filled the buffer tray have been moved to the feeder tray.
Figure 5C:
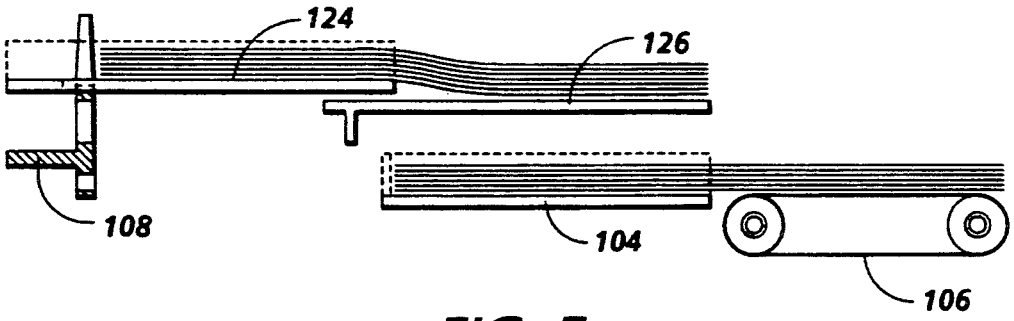
FIG. 5*c* is a schematic representation of the present invention in which more copy sheets having images on one side thereof are stacked image side up in the buffer tray.
Figure 5D:
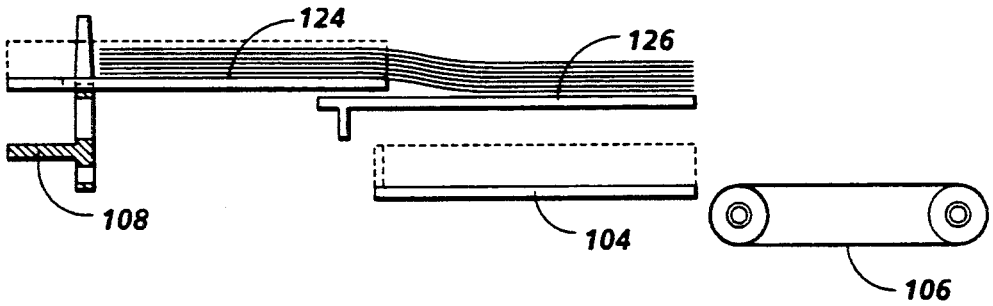
FIG. 5*d* is a schematic representation of the present invention in which copy sheets in the feeder tray have been fed to a copying station and the feeder tray is empty.
Figure 5E:
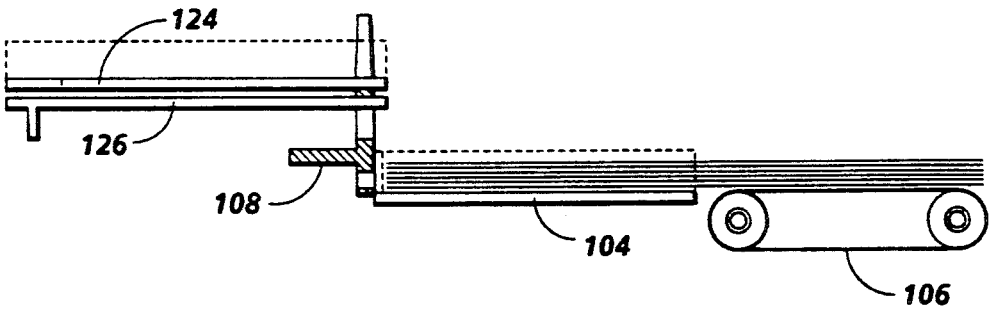
FIG. 5*e* is a schematic representation of the present invention in which copy sheets in the buffer tray have been moved to the feeder tray after the feeder tray has been emptied.

Another embodiment of the present invention in shown in FIG. 4, wherein buffer tray 160 is located directly above feeder tray 104. Buffer tray 160 is a solid platform positioned on guide rails (not shown) so that the entire buffer tray can be reciprocated through back guide 108. In this embodiment, it is not necessary to move back guide 108 since the copy sheets will be correctly positioned in feeder tray 104 as buffer tray 160 reciprocates to its retracted position. Alternatively, buffer tray 160 could be located upstream and in-line with feeder tray 104, if desired.

In operation, and in respect to FIGS. 5*a*–5*e*, a copy sheet having images on one side thereof and coming through the duplex feeder transport 50 image side down is engaged in either slot 114 or 116 of the copy sheet inverter causing it to rotate in the direction of the arrow. As the inverter 110 rotates, the copy sheet contacts the protrusions 120 and 122 of the back guide, disengages from the inverter 110, and falls into the buffer tray 102. This process continues until the buffer tray 102 is full based on the predetermined maximum capacity programmed into machine controller 132. Machine controller 132 counts copy sheets as they leave copy sheet input tray 38, 40 or 42. When buffer tray 102 is full (see FIG. 5*a*) machine controller 132 triggers motor 70 so that first screw 128 and second screw 142 turn. The turning of the screws 128 and 142 reciprocates the back guide 108 to its extended position and the movable portion 126 of the buffer tray 102 to its retracted position thereby pushing the stack of copy sheets on the buffer tray off the fixed portion 124 of the buffer tray so that they fall into the feeder tray (see FIG. 5*b*). At this point the machine controller 132 triggers the motor to turn the screws in the opposite direction so that back guide 108 is reciprocated to its retracted position and the movable portion 126 of the buffer tray is reciprocated to its extended position to receive more simplexed copy sheets as they disengage from copy sheet inverter 110. Copy sheets continue to be stacked in buffer tray 102 until the stack of original documents in the holding tray 28 have been copied on the first pass (see FIG. 5*c*). At this point the copy sheets are readied for page image information to be copied to the other side of the simplexed copy sheets on the second pass. When the second pass begins the VCF 106 is activated so that copy sheets are drawn in seriatim from the bottom of the stack of copy sheets in feeder tray 104. At this time machine controller 132 starts to count the number of copy sheets fed out of the duplex feeder 100. When feeder tray 104 is empty (see FIG. 5*d*), based on the copy count of the machine controller, the machine controller triggers motor 70 to turn the screws 128 and 142. The turning of the screws reciprocates the back guide 108 to its extended position and the movable portion 126 of the buffer tray to its retracted position, and pushes the stack of copy sheets on the buffer tray off the fixed portion 124 of the buffer tray so that they fall into the feeder tray (see FIG. 5*e*). VCF 106 continues to feed the simplex copy sheets to the transfer station for duplex copying until there are no more copy sheets in the duplex feeder 100. The feeding procedure described above would be repeated if there were more than one buffer tray 102 in the duplex feeder 100.

While there has been illustrated and described what is at present considered to be the preferred embodiments of the present invention, it will be appreciated that numerous changes and modifications are likely to occur to those skilled in the art, and it is intended in the appended claims to cover all those changes and modifications which fall within the true spirit and scope of the invention.

We claim:

1. An apparatus capable of transferring page image information onto both sides of a copy sheet, comprising:

producing means for producing images of the page image information;

receiving means for receiving images of the page image information from said producing means;

transfer means for transferring the images of the page image information from said receiving means to copy sheets;

input means including a first feeder tray and a feed member positioned in feeding relationship with respect to copy sheets within said feeder tray for inputting the copy sheets from said feeder tray to said transferring means for the transferring of images to the copy sheets;

inverter means for changing a orientation of the copy sheets from image side down to image side up;

duplex transport means for transporting the copy sheets from said transfer means to said inverter means;

duplex feeder means for receiving the copy sheets as the copy sheet fall from said inverter means and refeeding the copy sheets to said transfer means for transferring page image information to the other side of the copy sheets, said duplex feeder means having a buffer tray, a second feeder tray, moving means for moving copy sheets from said buffer tray to said second feeder tray, and feeder means for feeding copy sheets from said second feeder tray to said transferring means for transferring images onto the other side of the copy sheet; sensing means for sensing that said buffer tray is full, that said second feeder tray is empty, and for triggering said moving means; and output means for receiving the copy sheets having page image information on both sides thereof.

2. The apparatus of claim 1, wherein said buffer tray of said duplex feeder is positioned upstream and above said second feeder tray.

3. The apparatus of claim 2, wherein said buffer tray includes a retractable portion such that when extended copy sheets having images on one side thereof are supported thereon and forms a stack and when retracted the stack of copy sheets fall to said second feeder tray.

4. The apparatus of claim 3, wherein said moving means is a movable back guide positioned tangential to the stack of copy sheets and having slots therein to allow said guide to move past said buffer tray such that said guide can move the stack of copy sheets from said buffer tray to said second feeder tray.

5. The apparatus of claim 4, wherein said inverting means aligns the copy sheets uniformly against said back guide.

6. The apparatus of claim 1, wherein said buffer tray is positioned above second feeder tray.

7. The apparatus of claim 6, wherein said buffer tray can be retracted from its original position to permit a stack of sheets to fall to said second feeder tray.

8. The apparatus of claim 1, wherein said feeder means is a vacuum feed head.

9. The apparatus of claim 8, wherein said feeder means is positioned such that it feeds the copy sheets from the bottom of the stack.

10. The apparatus of claim 1, wherein said sensing means is a machine controller which counts a number of sheets fed into said feeder.

11. The apparatus of claim 4, wherein said inverting means in cooperation with said back guide simultaneously inverts and aligns the copy sheets uniformly within said buffer tray.

12. A duplex feeder for feeding copy sheets having images on one side thereof to a copying station for imaging on the other side thereof, comprising:

a feeder for feeding the copy sheets to the copying station;

a feeder tray for supporting a stack of the copy sheets to be fed by said feeder;

at least one stationary buffer tray separate from said feeder tray for stacking the copy sheets when said feeder tray is full;

moving means for moving the copy sheets from said buffer tray to said feeder tray; and sensing means for sensing that said buffer tray is full and that said feeder tray is empty and for triggering said moving means.

13. The duplex feeder of claim 12, wherein said feeder is a vacuum feed head.

14. The duplex feeder of claim 13, wherein said feeder is positioned such that it feeds the copy sheets from the bottom of the stack.

15. The duplex feeder of claim 12, wherein there is one buffer tray.

16. The duplex feeder of claim 15, wherein said buffer tray is positioned upstream and above said feeder tray.

17. The duplex feeder of claim 16, wherein said buffer tray includes a retractable portion such that when extended the copy sheets are supported thereon and when retracted the sheets fall due to gravity to said feeder tray.

18. The duplex feeder of claim 16, wherein said moving means is a movable back guide positioned tangential to the stack of copy sheets and having slots therein to allow said guide to move past said buffer tray such that the guide can move the sheets from said buffer tray to said feeder tray.

19. The duplex feeder of claim 18, further comprising inverting means for inverting the copy sheets such that the sheets are stacked image side up in the buffer tray, and such that the sheets are uniformly aligned against said back guide.

20. The duplex feeder of claim 12, wherein said sensing means is a machine controller which counts a number of copy sheets fed into said feeder.

21. A method of feeding copy sheets, having images on one side thereof to a copying station for imaging on the other side thereof, comprising the steps of:

stacking the copy sheets in a buffer tray after imaging on one side thereof;

sensing when said buffer tray is full;

moving the copy sheets from said buffer tray to a feeder tray when said buffer tray is full;

receiving more copy sheets in said buffer tray;

feeding the copy sheets from said feeder tray to said copying station for imaging on the other side thereof;

sensing when said feeder tray is empty; and moving the copy sheets from said buffer tray to said feeder tray when said feeder tray is empty such that the sheets can be fed to the copying station for imaging on the other side thereof.

22. The method of claim 21, further comprising the step of inverting the copy sheets prior to stacking the sheets in the buffer tray such that the sheets can be fed image side up.

23. A duplex feeder for feeding copy sheets having images on one side thereof to a copying station for imaging on the other side thereof, comprising:

a feeder for feeding the copy sheets to the copying station;

a feeder tray for supporting a stack of the copy sheets to be fed by said feeder;

at least one buffer tray for stacking the copy sheets when said feeder tray is full, said at least one buffer tray having a fixed portion and a retractable portion;

moving means for moving the copy sheets from said buffer tray to said feeder tray; and sensing means for sensing that said buffer tray is full and that said feeder tray is empty and for triggering said moving means.

24. The duplex feeder of claim 23, wherein said buffer tray is positioned directly above said feeder tray.

25. The duplex feeder of claim 24, wherein said buffer tray is retractable from said position directly above said feeder tray to a position removed from said feeder tray in order to allow copy sheets in said buffer tray to fall onto said feeder tray.

26. The duplex feeder of claim 23, wherein said buffer tray is non-rotatable.

* * * * *